US006059694A

United States Patent [19]

Villepigue

[11] Patent Number: 6,059,694

[45] Date of Patent: May 9, 2000

[54] HAND EXERCISER EMPLOYING FINGER POWER BANDS

[76] Inventor: James Villepigue, 27 Rush Pl., Oyster Bay, N.Y. 11771

[21] Appl. No.: 09/097,523

[22] Filed: Jun. 15, 1998

[51] Int. Cl.[7] ..... A63B 23/16

[52] U.S. Cl. ..... 482/47; 482/48; 482/44; 294/25

[58] Field of Search ..... 482/47, 44, 45, 482/48, 49, 124; 601/40; 602/21, 22; 475/59, 61; D21/198; 2/16, 161.1, 161.4, 161.5; 294/25

[56] References Cited

U.S. PATENT DOCUMENTS

| | | | |
|---|---|---|---|
| 849,182 | 4/1907 | Adkins | 2/161.6 |
| 897,471 | 9/1908 | Loyola | 482/48 |
| 2,108,236 | 2/1938 | Scott | 482/48 |
| 3,347,547 | 10/1967 | Hynes | 482/47 |
| 3,605,117 | 9/1971 | Latina | 2/161.1 |
| 4,766,612 | 8/1988 | Patton, Sr. | 2/161.1 |
| 5,231,700 | 8/1993 | Cutshall | 2/161.7 |
| 5,601,529 | 2/1997 | Wollman | 601/74 |
| 5,640,712 | 6/1997 | Hansen et al. | 2/161.1 |

FOREIGN PATENT DOCUMENTS

| | | | |
|---|---|---|---|
| 11689 | 7/1905 | United Kingdom | 482/44 |

*Primary Examiner*—Richard J. Apley
*Assistant Examiner*—Justine R. Yu
*Attorney, Agent, or Firm*—Michael I. Kroll

[57] ABSTRACT

An apparatus for exercising a hand of a user allowing a full range of motion of the hand during use. The hand exerciser includes a dorsal wrap releasably secured about a wrist of the user and extending over a back side of the hand. A finger power band releasably engages the dorsal wrap and extends over at least one finger of the hand of the user providing a resistance to movement of the at least one finger. A thumb power band is also releasably engaged with the dorsal wrap and extends along a surface of a thumb of the hand of the user providing a resistance to movement of the thumb. The finger and thumb power bands move independently of each other allowing exercise of any of the entire hand, any individual finger or thumb and any combination thereof. Furthermore, the resistance provided by the finger and thumb power bands is adjustable based upon the strength of the user. Finger and thumb power bands having variable resistance levels may be interchangeably connected to the dorsal wrap as desired. On an end of both the finger and thumb power bands opposite their respective connections with the dorsal wrap is a finger receiving cup for receiving a finger of the user and aiding in retaining the hand exerciser in position on the hand. The finger and thumb power bands are color coated, the color of the finger and thumb power bands indicating the amount of resistance provided thereby. The resistance level of the finger and thumb power bands are rated on a scale system having a range of values, each value within the range being representative of a resistance level.

11 Claims, 11 Drawing Sheets

HAND EXERCISER EMPLOYING FINGER POWER BANDS

BACKGROUND OF THE INVENTION

1. Field of the Invention

The present invention relates generally to exercising devices and, more specifically, to a hand exerciser worn directly on a hand or over a glove of a user providing resistance while allowing the user to flex either the entire hand or any individual digit in a natural movement through a full range of motion thereby exercising the hand and digits in a safe, highly effective manner and providing faster results than products without a fill range of motion. The hand exerciser increases the strength, coordination and gripping ability of the hand and digits of a user as well as providing physical therapy for treating conditions such as arthritis, carpal tunnel syndrome, weak muscles and joints and post surgical weakness.

2. Description of the Prior Art

Numerous exercising devices have been provided in the prior art. Known hand flexion and extension exercise devices satisfy only a limited number of the desired criteria for fully exercising the hand and digits of a user. The most common deficiency of known devices is in the ability to exercise the full range of motion for each joint. These devices do not provide for the separate exercise of the major joint classifications but use one simple motion for exercising the entire hand and digits. Furthermore, most of these devices provide an inappropriate distribution of resistance to the various joints, e.g. the functional capabilities of the metacarpophalangeal joints greatly exceeds that of the distal interphalangeal joints and therefore resistance should be applied to these joints based upon their functional capabilities and not evenly. For example, U.S. Pat. No. 5,538,488 to Villepigue is illustrative of such prior art. While this unit may be suitable for the particular purpose to which it addresses, it would not be as suitable for the purposes of the present invention as heretofore described.

U.S. Pat. No. 5,538,488

Inventor: James C. Villepigue, also inventor of the present application

Issued: Jul. 23, 1996

A glove for exercising digits of a human hand. The inventive device includes an inner glove for receiving a human hand therein. Digit cups are secured to the inner glove for receiving the outermost portion of each digit. A plurality of spring-loaded tension cables extend along a posterior of the glove and operate to resist motion of the glove during closing of the hand. An adjustment assembly effects tensioning of the cables to a desired resistance.

SUMMARY OF THE INVENTION

The present invention relates generally to exercising devices and, more specifically, to a hand exerciser worn directly on a hand or over a glove of a user providing resistance while allowing the user to flex either the entire hand or any individual digit in a natural movement through a full range of motion thereby exercising the hand and digits in a safe, highly effective manner and providing faster results than products without a full range of motion. The hand exerciser increases the strength, coordination and gripping ability for the hand and digits of a user as well as providing physical therapy for treating conditions such as arthritis, carpal tunnel syndrome, weak muscles and joints and post surgical weakness.

A primary object of the present invention is to provide a hand exerciser that will overcome the shortcomings of the prior art devices.

Another object of the present invention is to provide a hand exerciser that can be worn directly on a hand of a user or over a glove allowing the user to flex either the entire hand or any individual digit in a natural movement through a full range of motion providing a safe, highly effective exercise.

An additional object of the present invention is to provide a hand exerciser that will increase the strength, coordination and gripping ability for the hand and digits of the user as well as providing physical therapy for conditions such as arthritis, carpal tunnel syndrome, weak muscles and joints and post surgical weakness, etc.

A still further object of the present invention is to provide a hand exerciser that will not inhibit the normal motion of the hands of the user.

An even further object of the present invention is to provide a hand exerciser that may be worn while performing any desired activity such as driving or playing sports without inhibiting use of the hand.

Another object of the present invention is to provide a hand exerciser that conforms to the shape of the users hand becoming a natural extension of the body for proper hand kenesiology.

A further object of the present invention is to provide a hand exerciser that provides for variable resistance levels for adapting to the strength level of different users and to the increasing strength level of a user exercising with the hand exerciser.

A yet further object of the present invention is to provide a hand exerciser that provides a full range of motion from full hand extension to full hand flexion thereby exercising the entire hand along with certain flexor and extensor muscles of the forearm.

An even further object of the present invention is to provide a hand exerciser that is simple and easy to use.

A still further object of the present invention is to provide a hand exerciser that is economical in cost to manufacture as well as economically consumer friendly.

Further objects of the invention will appear as the description proceeds.

An apparatus for exercising a hand of a user allowing a full range of motion of the hand during use is described by the present invention. The hand exerciser includes a dorsal wrap releasably secured about a wrist of the user and extending over a back side of the hand. A finger power band releasably engages the dorsal wrap and extends over at least one finger of the hand of the user providing a resistance to movement of finger(s). A thumb power band is also releasably engaged with the dorsal wrap and extends along a surface of a thumb of the hand of the user providing a resistance to movement of the thumb. The finger and thumb power bands move independently of each other allowing exercise of any of the entire hand, any individual finger, the thumb and any combination thereof. Furthermore, the resistance provided by the finger and thumb power bands is adjustable based upon the strength of the user. Finger and thumb power bands having variable resistance levels may be interchangeably connected to the dorsal wrap as desired. On an end of both the finger and thumb power bands opposite their respective connections with the dorsal wrap is a tip cup for receiving a finger or thumb of the user and aiding in retaining the hand exerciser in position on the hand.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCE NUMERALS

Figure 1:
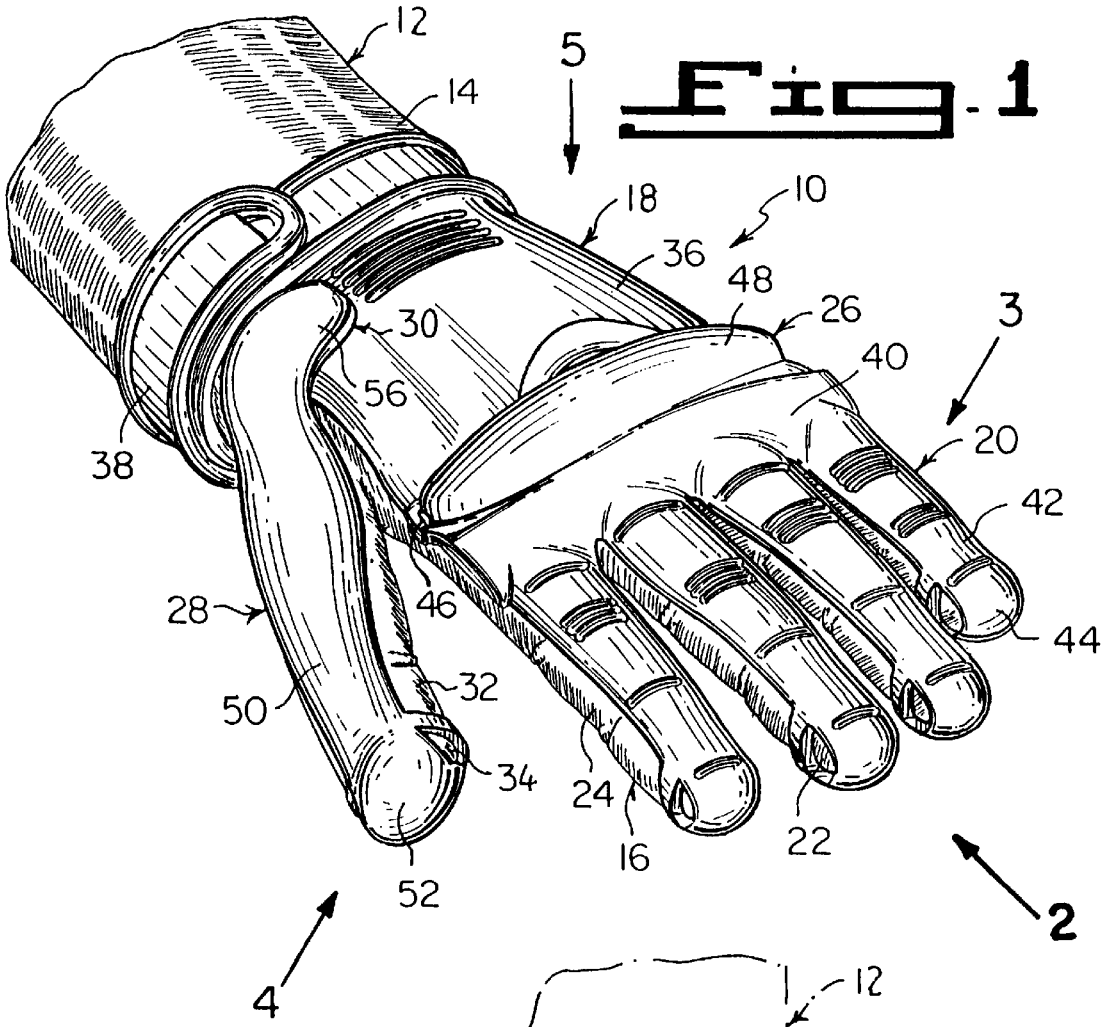
FIG. 1 is a top perspective view of the hand exerciser of the present invention for exercising the left hand of a user.

Turning now descriptively to the drawings, in which similar reference characters denote similar elements throughout the several views, the Figures illustrate the hand exerciser of the present invention.

DETAILED DESCRIPTION OF THE PREFERRED EMBODIMENT

Turning now descriptively to the drawings, in which similar reference characters denote similar elements throughout the several views, FIGS. 1 through 9*a* illustrate the hand exerciser of the present invention. The hand exerciser is indicated generally by the reference numeral 10.

The hand exerciser 10 is clearly illustrated in FIG. 1 being worn about a wrist 14 of a user 12, so as to extend over a back side of a hand 16 of the user 12. The hand exerciser 10 includes a dorsal wrap 18 removably extending around the wrist 14 and along the back of the hand 16 of the user 12, a finger power band 20 pivotally and releasably connected to the dorsal wrap 18 and a thumb power band 28 releasably connected to the dorsal wrap 18.

The finger power band 20 is pivotally connected to the dorsal wrap 18 by a connector 26. The finger power band 20 consists of a knuckle covering 40 extending from the connection with the connector 26 and over the knuckles of the hand 16 of the user 12. At least one finger cover portion 42 and preferably one finger cover portion 42 for each finger of the user 12 is integrally connected to the knuckle covering 40 and extends over a back side and along the surface of a respective finger 24 of the user 12. The finger tip cup 44 is connected at an end of each finger cover portion 42 opposite the knuckle covering 40. Each finger tip cover 44 is integral with an outermost end of its respective finger cover portion 42, so as to engage with and cover a finger tip 22 of the user 12. The finger cover portion 42 is moveable with its respective finger 24 applying a resistive force to the finger 24 during movement. The connector 26 is positioned between the finger power band 20 and the dorsal wrap 18 for detachably coupling the finger power band 20 to the dorsal wrap 18. The finger power band 20 is pivotally connected to the dorsal wrap 18 via the connector 26 whereby the finger power band 20 is able to pivot and move with the fingers 24 and knuckles of the user 12. The connection between the finger power band 20 and the dorsal wrap 18 will be discussed in detail hereinafter.

The finger cover portions 42 are made of a flexible material allowing bending at the finger joints covered thereby. The position of the finger joints below the finger cover 42 are indicated by knuckle strips 55 extending across the width of the finger covers 42. Finger power bands 20 of any desired length/size and resistance may be connected to the dorsal wrap 18 to match the size and strength of the user 12.

The thumb power band 28 is removably connected to the dorsal wrap 18 by a connection assembly 30. The thumb power band 28 includes a thumb cover 50 which extends over a thumb 32 of the user 12 and a thumb tip cup 52 for engaging a tip 34 of the thumb 32 during use. The thumb power band 28 covers the back side of the thumb 32, moving with the thumb 32 as it is flexed and extended while providing a resistance to the movement of the thumb 32. The finger power band 20 and thumb power band 28 move independently of one another. In this arrangement, the user 12 is able to flex the hand 16, each of the four fingers 24 and the thumb 32 within their natural range of movement either together, individually or in any combination thereof to thereby exercise the entire hand.

The dorsal wrap 18 includes a back covering 36 which extends over the back of the hand 16 of the user 12. A wrist wrap 38 is integrally connected to the back covering 36 for extending around the wrist 14 of the user 12 during use. The wrist wrap 38 maintains contact between the hand exerciser 10 and the wrist 14 during use. The wrist wrap 38 includes a device for releasably securing it about the wrist of the user such as a buckle or a VELCRO® connection. The back covering 36 extends to the knuckles of the user 12 for connection with the finger power band 20 via the connector 26.

Figure 2:
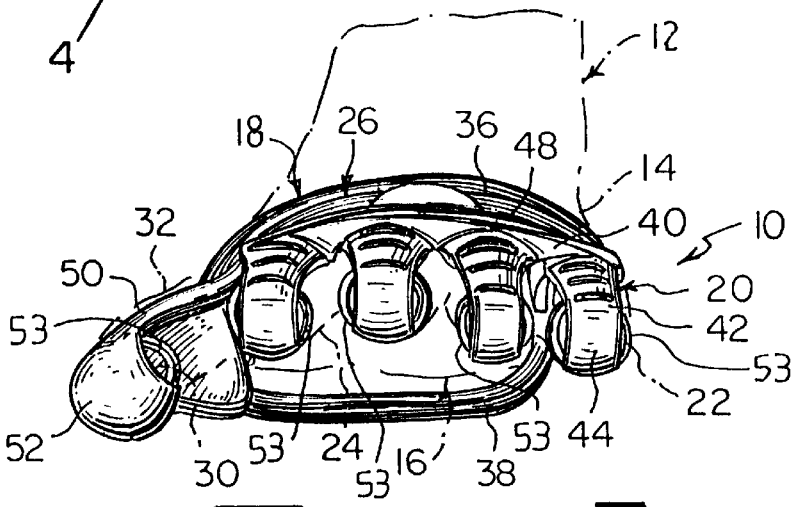
FIG. 2 is a front perspective view of the hand exerciser of the present invention taken in the direction of the arrow labeled 2 in FIG. 1, with the left hand of the user shown in phantom.

A front perspective view of the hand exerciser 10 is illustrated in FIG. 2. From this view, the finger tip cups 44 and the thumb tip cup 52 are clearly seen. The tip cups 44 and 52 each extend over the tip of their respective finger to engage with the finger. Also connected to each finger and thumb tip cup 44 and 52 is a fingertip band 53 for extending around a respective finger and removably securing the tip cup thereto.

Figure 3:
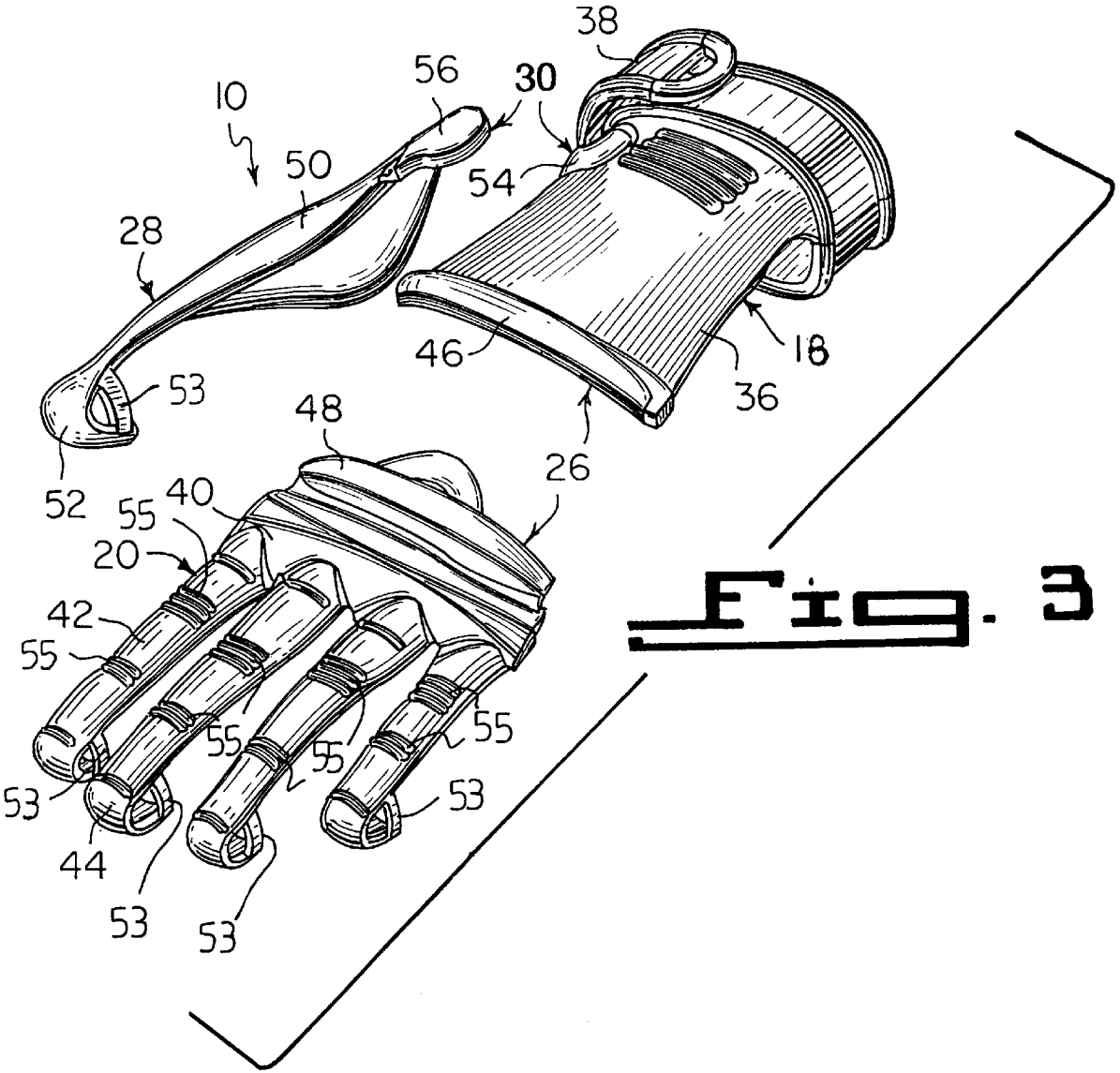
FIG. 3 is an exploded top perspective view of the hand exerciser of the present invention for exercising the left hand of the user taken in the direction of the arrow labeled 3 in FIG. 1.
Figure 3A:
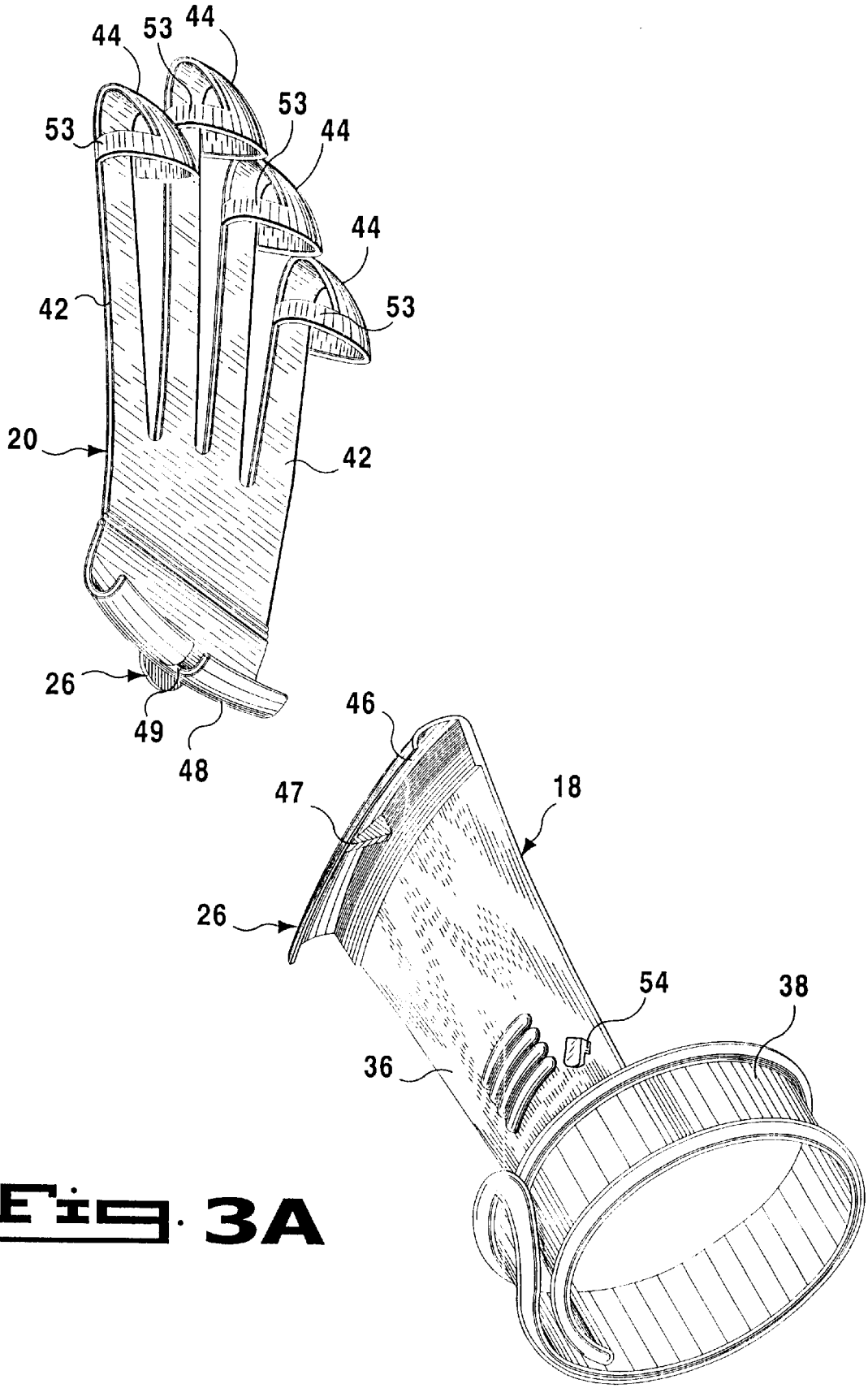
FIG. 3A is an exploded side perspective view of the dorsal wrap and finger power band of the hand exerciser of the present invention for exercising the left hand of the user.

The connector 26 for connecting the finger power band 20 to the dorsal wrap 18 and the connection assembly 30 for connecting the thumb power band 28 to the dorsal wrap 18 are clearly illustrated in FIGS. 3 and 3A. The connector 26 includes a grip member 46 affixed to the dorsal wrap 18 with a pin 47 extending from the grip member 46. A hook member 48 of the connector 26 is affixed to the finger power band 20 and includes a recess 49. The hook member 48 acts to engage the grip member 46 and the recess 49 receives and retains the pin 47 therein for releasably connecting the dorsal wrap 18 to the finger power band 20 as will be described hereinafter.

The thumb power band 28 includes the thumb covering 50, which extends over the thumb 32 of the user 12. The thumb tip cup 52 is integrally connected with an outermost end of the thumb covering 50, so as to extend over and cover the tip 34 of the thumb 32. The thumb tip cup 52 includes the fingertip band 53 for extending around the tip 34 of the thumb 32 thereby retaining the thumb covering 50 in contact with the thumb 32. The connector assembly 30 includes a protrusion 54 connected to and extending from the dorsal wrap 18 at the point at which the thumb power band 28 is to be releasably attached. A recess 56 extends through the thumb power band 28 and receives the protrusion 54 therein for releasably connecting the thumb power band 28 to the dorsal wrap 18.

The finger power band 20 is colored, with the color of the finger power band 20 being indicative of the specific power band strength 20. The color of the power band 20 is thus indicative of the resistance provided thereby. Preferably, the resistance of the color bands 20 are measured on a scale system defining a range of values, each value being indicative of a particular resistance level. The power band rated at the level 1 provides the least resistance and the color band rated at the level 4 providing the greatest resistance. The resistance of the color band will be indicated thereon and will not be visible when the hand exerciser 10 is in use.

Figure 4:
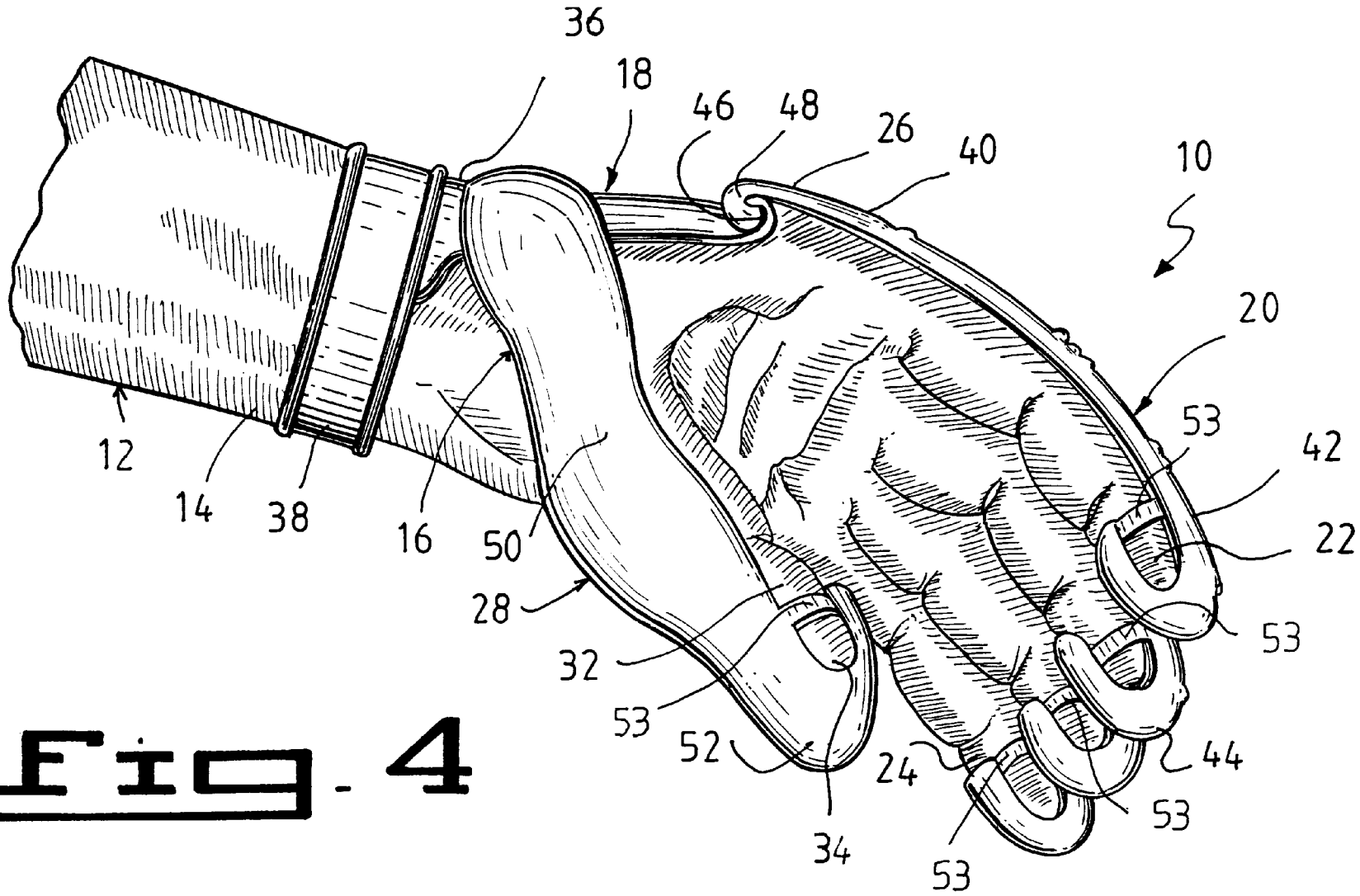
FIG. 4 is a side perspective view of the hand exerciser of the present invention taken in the direction of the arrow labeled 4 in FIG. 1.

A side view of the hand exerciser 10 positioned about a user's hand 16 is illustrated in FIG. 4. From this view, the interconnection of the grip member 46 and the hook member 48 of the connector 26 is clearly seen. The hook member 48 is connected with a finger power band 20 for receiving and releasably engaging the grip member 46 thereby connecting the finger power band 20 to the dorsal wrap 18. The grip member 46 is configured to be received by and engage any hook member 48 connected to a finger power band 20 of any desired length and resistance. Thus, the hand exerciser 20 is easily adapted for use by persons having any size fingers and of any strength level by securing a hook member 48 connected with any desired finger power band 20 to the grip member 46. When the grip member 46 engages the hook member 48, the pin 47 is caused to be received in the recess 49 thereby connecting the finger power band 20 and the dorsal wrap 18. The wrist wrap 38 is releasably attached to the wrist 14 of the user 12 for securing the dorsal wrap 18 in position and the thumb power band 28 is connected to extend from the back covering 36 of the dorsal wrap 18.

In use, the fingers of the user 12 are positioned to be covered by a respective one of the finger covers 42 whereby the finger tips 22 are received in a respective finger tip cup 44. The fingertip bands 53 each extend around a respective one of the finger tip cups 44 and hold the respective finger tip 22 therein. The thumb power band 28 also includes the thumb tip cup 52 for receiving the tip of the thumb 32 and the fingertip band 53 extends around the thumb tip cup 52 holding the thumb 32 therein.

Figure 4A:
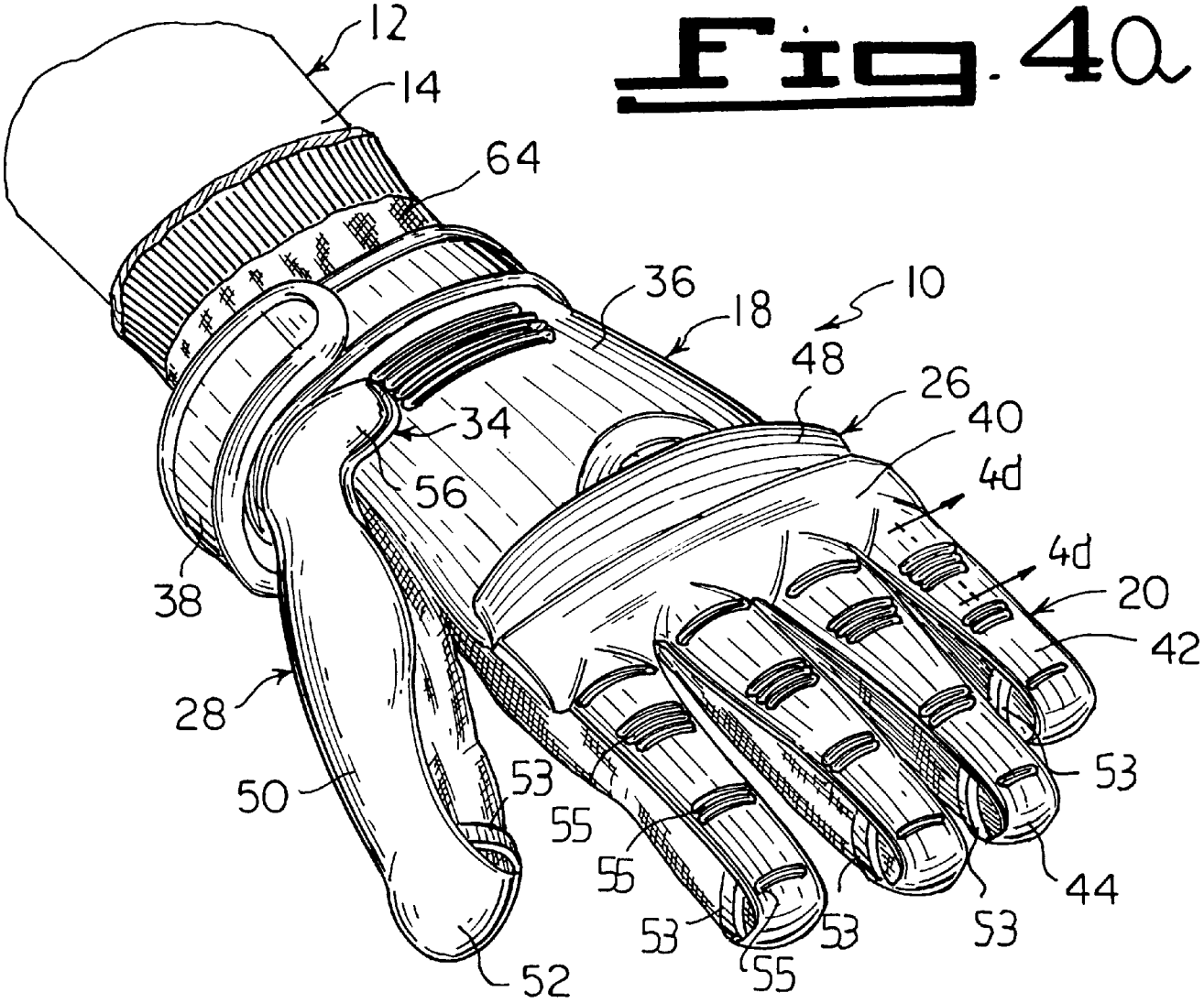
FIG. 4*a* is a top perspective view of the hand exerciser of the present invention similar to FIG. 1, showing the present invention worn over a glove on the left hand of the user.

A top perspective view of the hand exerciser 10 positioned over a glove 64 on the hand of a user 12 is illustrated in FIG. 4*a*. This view is similar to that of FIG. 1 showing the use of the hand exerciser 10 of the present invention with a glove 64 covering the user's hand 16. The hand exerciser 10 is used in the same manner with or without a glove 64 covering the hand of the user 12. The user 12 can also perform other tasks when using the hand exerciser 10, such as driving a motor vehicle or performing other exercises. The finger power bands 20 and the thumb power band 28 can be made in varying strengths and can be color coded, so as to change the flexing exercise of the hand 16, fingers 24 and thumb 32 and thus provide a desired resistance for the user to overcome when moving the fingers.

Figures 4B, 4C, 4D:
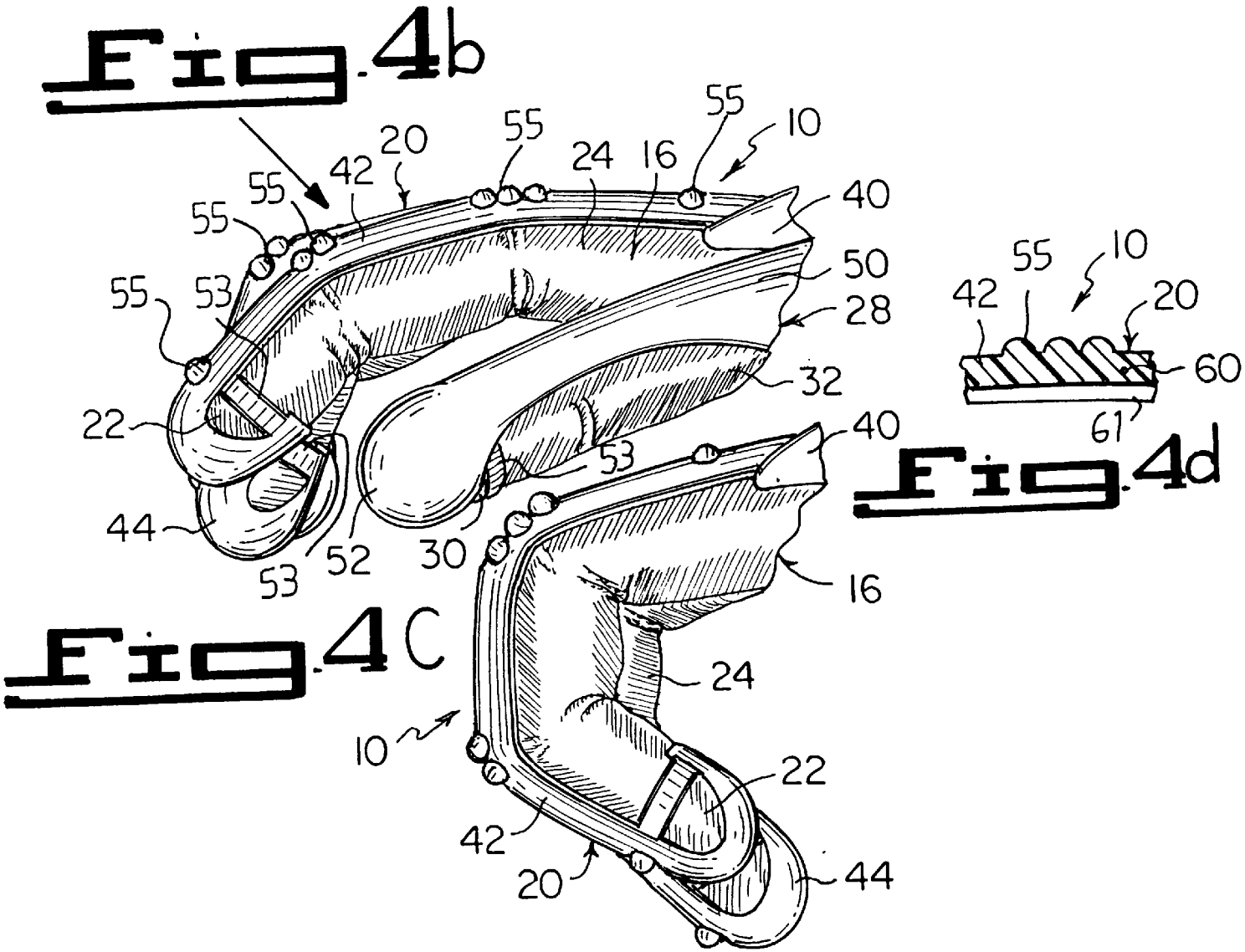
FIG. 4*b* is a partial side view of the hand exerciser of the present invention worn on a right hand of the user.
FIG. 4*c* is a partial side view of the hand exerciser of the present invention similar to FIG. 4*b,* showing a partial flexion of the fingers of the right hand of the user.
FIG. 4*d* is a cross-sectional view of the hand exerciser of the present invention taken along line 4*d*—4*d* in FIG. 4*a;*

A side view of a right handed hand exerciser 10 is illustrated in FIG. 4*b*. From this view the fingers can be clearly seen positioned within the tip cups 44 and the thumb can be seen positioned in the tip cup 52. The fingers and thumb are wrapped by the fingertip bands 53. The knuckle strips 55 are also visible from this view. The finger covers 42 extend above the fingers and along the length thereof with the knuckle strips 55 positioned above the finger joints.

A side view illustrating the bending of the fingers is illustrated in FIG. 4*c*. As can be seen from this figure, the knuckle strips 55 are positioned above the finger joints and the finger covers 42 bend at the position of the knuckle strips 55. When the fingers 24 are bent, the finger cover 42 will stretch at the bending point positioned below the knuckle strips 55 due to the elasticity of the material used to form the finger covers 42. The resistance to movement provided by the finger covers 42 will vary, the approximate resistance being indicated by the color of the power band 20 and a scale system, the scale system preferably ranges from a value of 1 indicating least resistance to a value of 4 indicating greatest resistance. The resistance value of each power band 20 is indicated on the back side thereof. To increase or decrease the resistance, the finger power band 20 may be replaced with another finger power band 20 having a different resistance level by disengaging the hook member 48 from the grip member 46 and reconnecting a finger power band 20 having the desired length and resistance.

A cross-sectional view of a portion of the finger cover 42 taken in the direction of the arrows labeled 4*d*—4*d* in FIG. 4*a* is illustrated in FIG. 4*d*. This view shows the knuckle strips 55 positioned above the finger cover 42 and integrally connected thereto. The finger cover 42 is formed from an elastomeric thermoplastic material and therefore is somewhat flexible. The flexibility of the material allows for the movement of the fingers of a user 12 while providing a resistance to the movement. The resistance to the movement of the fingers causes the fingers to be exercised whenever they are moved. The amount of resistance is dependent upon the flexibility of the finger covers 42. The flexibility of the finger covers 42 is determined upon manufacture and is based upon the percentage of elastomeric material used to form the finger covers 42. The resistance supplied by the finger and thumb power bands 20 and 28, respectively, is indicated by the color of the power band 20 and/or a numbered scale system of a range from 1–4 indicated on the back of the power band 20. Positioned on a side of the finger covers 42 opposite the knuckle strips 55 is a pad material 61 preferably formed of foam which contacts the skin of the user's fingers. The pad 61 provides added comfort for the user when using the hand exerciser 10.

Figure 5:
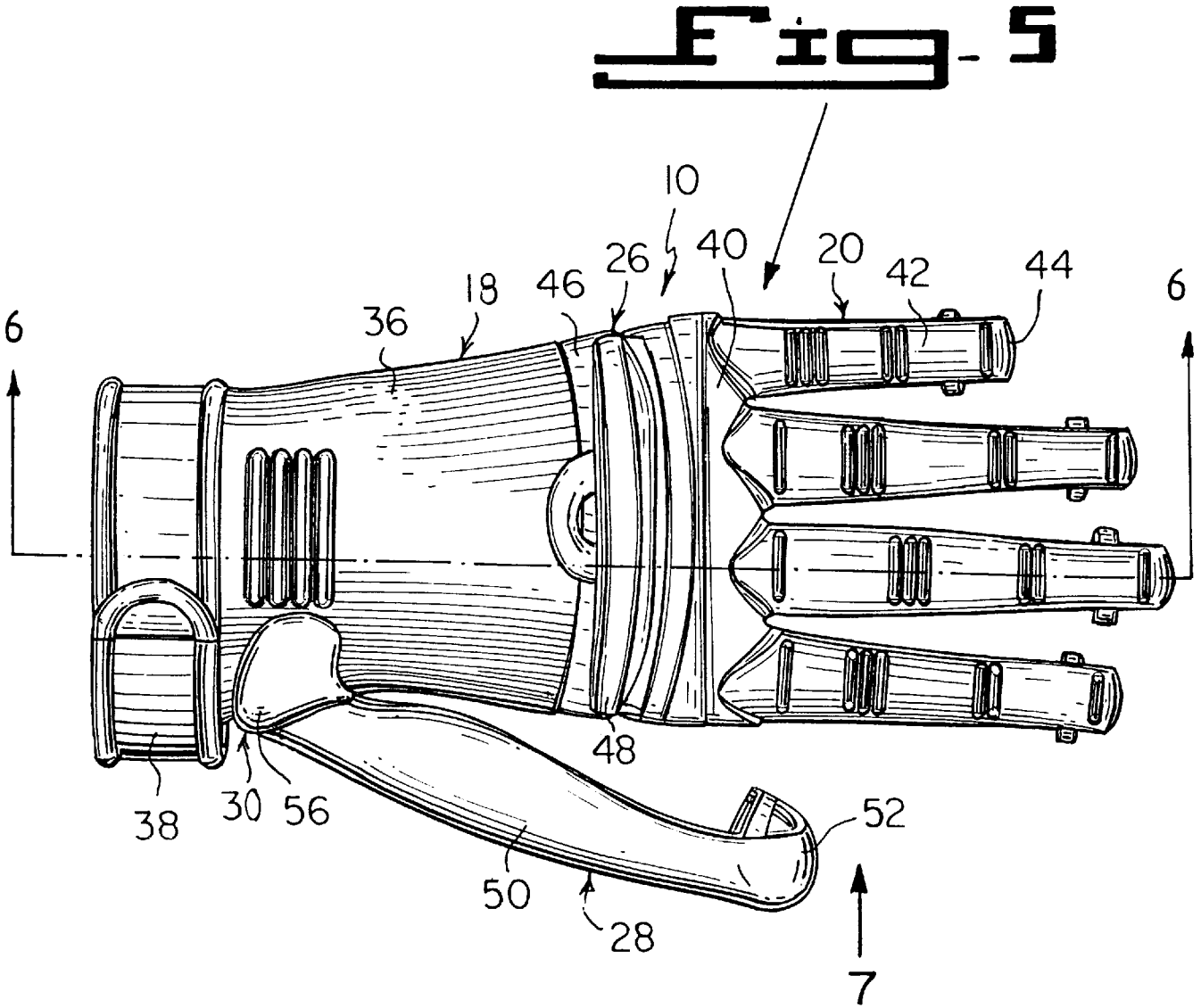
FIG. 5 is a top view of the hand exerciser of the present invention taken in the direction of the arrow labeled 5 in FIG. 1.

A top view of the hand exerciser 10 of the present invention can be seen from FIG. 5. This figure clearly illustrates the connection of the dorsal wrap 18, finger power band 20 and thumb power band 28 to form the hand exerciser 10 of the present invention. The hand of the user is positioned below the dorsal wrap 18 with the fingers positioned below respective ones of the finger covers 42 and received within the finger tip cups 44. The thumb of the user is positioned below the thumb cover 50 with the tip of the thumb being received and held within the thumb tip cup 52. This figure also illustrates the plug member 56 of the connector assembly 30 for connecting the thumb power band 28 to the dorsal wrap 18.

Figure 6:
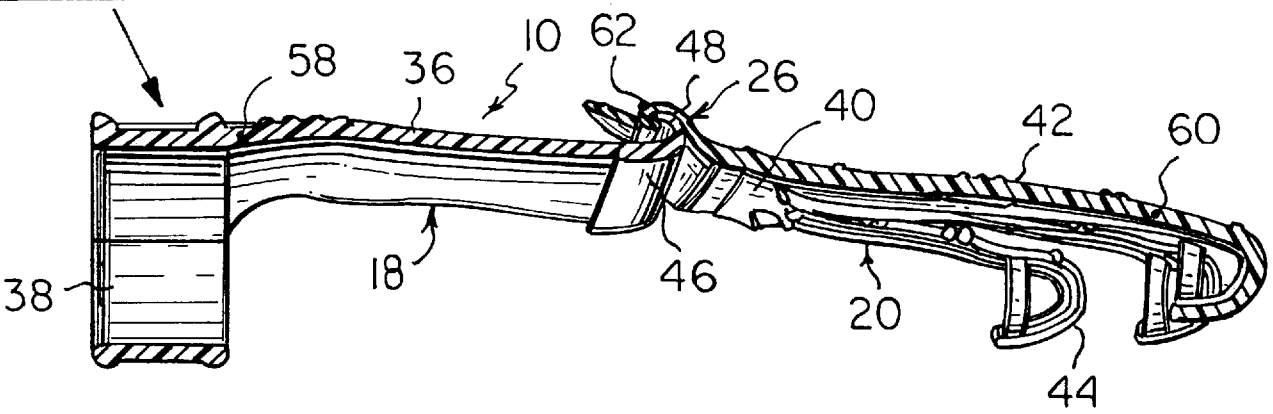
FIG. 6 is a cross-sectional view of the hand exerciser of the present invention taken along line 6—6 in FIG. 5.

A side cross-sectional view of the hand exerciser 10 taken along the line labeled 6—6 in FIG. 5 is shown in FIG. 6. This figure clearly illustrates the connector 26 including the interconnection between the grip member 46 and the hook member 48. As illustrated in this figure, the dorsal wrap 18 is fabricated out of a hard thermoplastic elastomeric material 58. Use of such material provides stiffness to the back cover 36 of the dorsal wrap 18 yet is pliable enough to conform to the shape of the hand 16 of the user. Each finger power band 20 is also preferably fabricated from a soft, pliable thermoplastic material thereby allowing the finger power bands 20 to stretch during a flexing exercise. The thumb power band 28 is fabricated out of the soft, pliable thermoplastic material allowing the thumb power band 28 to stretch and bend with the thumb of the user during a flexing exercise while also providing a measure of resistance to the thumb movement.

The connector assembly 36 is fabricated from a rigid thermoplastic material whereby the thumb power band 28 is prevented from inadvertent detachment from the dorsal wrap 18 during a flexing exercise. The connector 26 is also preferably formed from a rigid thermoplastic material 62 preventing the grip member 46 and the hook member 48 from being easily disengaged and thus, preventing the finger power band 20 from being unintentionally disconnected from the dorsal wrap 18 during a flexing exercise.

Figure 7:
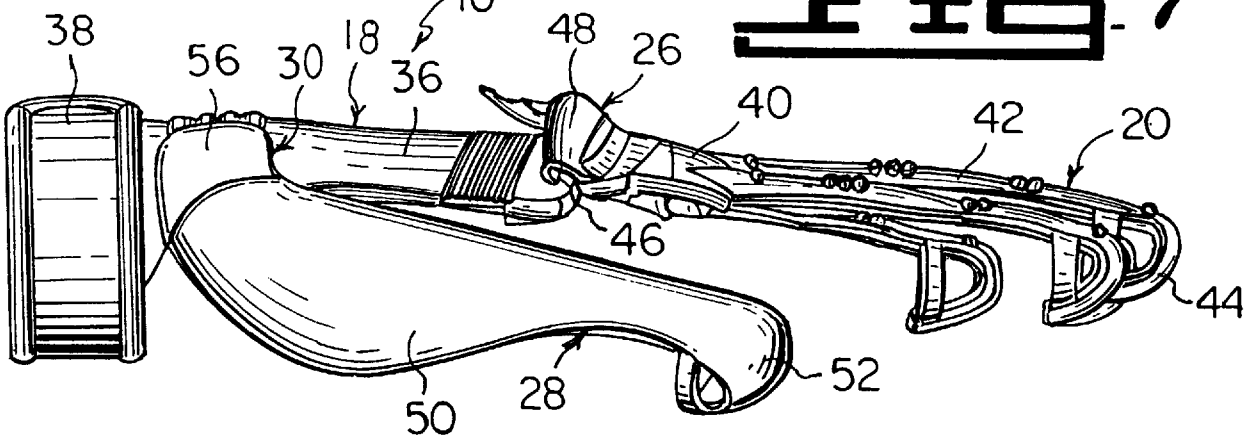
FIG. 7 is a side view of the hand exerciser of the present invention taken in the direction of the arrow labeled 7 in FIG. 5.

A further side view of the hand exerciser 10 taken in the direction of the arrow labeled 7 in FIG. 5 is illustrated in FIG. 7. This figure is similar to FIG. 6 including the thumb power band 28. The relationship between the thumb power band 28 and its connection to the dorsal wrap 18 is clearly seen along with its spatial relationship to the finger power band 20.

Figure 8:
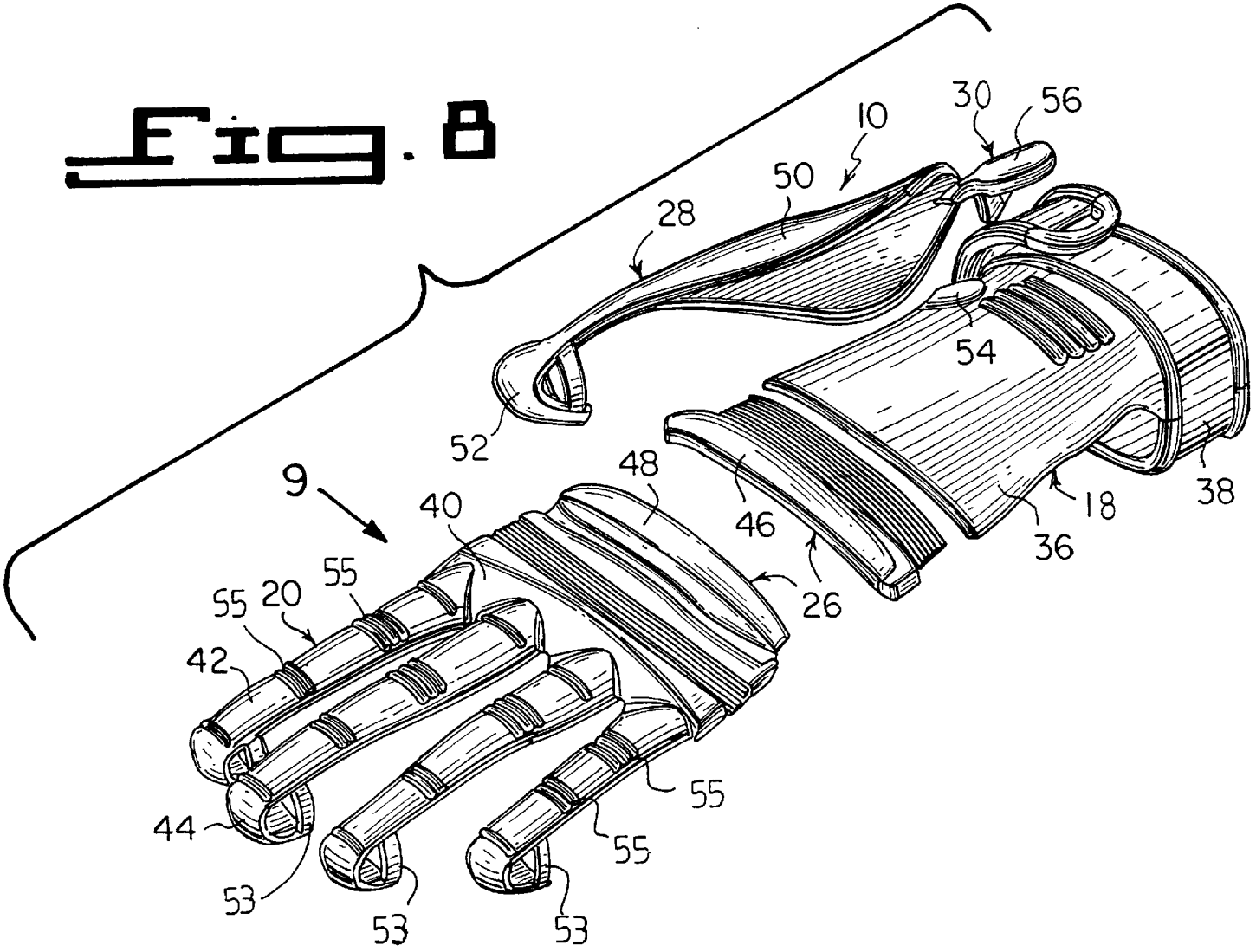
FIG. 8 is an exploded top perspective view of the hand exerciser of the present invention similar to FIG. 3.

An exploded top perspective view of the hand exerciser is illustrated in FIG. 8. From this view the releasable connection between the grip member 46 and the hook member 48 is clearly seen along with the pin 47 extending from the grip member 46 for receipt within the recess 49 of the hook member 48. Also shown in this figure is the connection assembly 30 for removably attaching the thumb power band 28 to the dorsal wrap 18. As can be seen from this view, the protrusion 54 is connected to and extends from the back side 36 of the dorsal wrap 18 and the recess 56 extends through the thumb power band 28. In order to removably secure the thumb power band 28 to the dorsal wrap 18, the protrusion 54 must be received by and held in the recess 56. Alternatively, the protrusion 54 may be formed with the thumb power band 28 and the recess 56 may be positioned extending through the dorsal wrap 18. Connecting the thumb power band 28 and the dorsal wrap 18 would be performed in the same manner.

Figure 9:
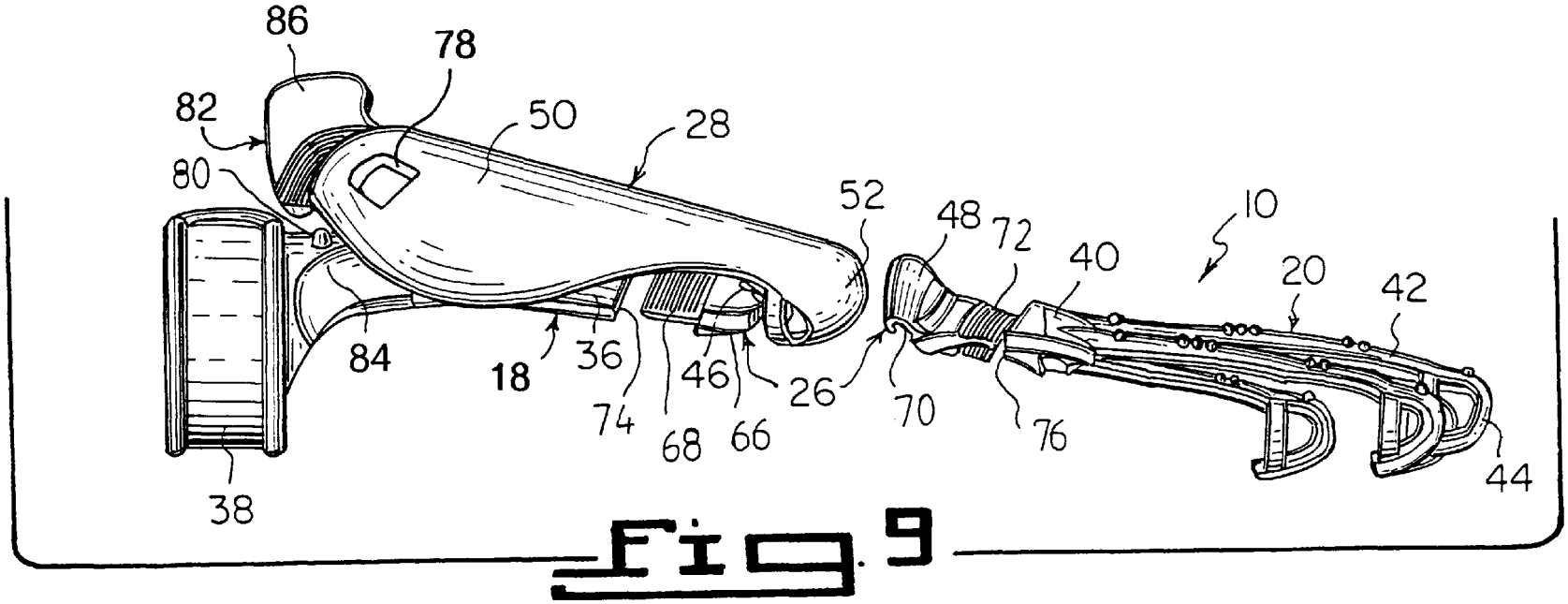
FIG. 9 is an enlarged, partially exploded side view of the hand exerciser of the present invention taken in the direction of the arrow labeled 9 in FIG. 8.
Figure 9A:
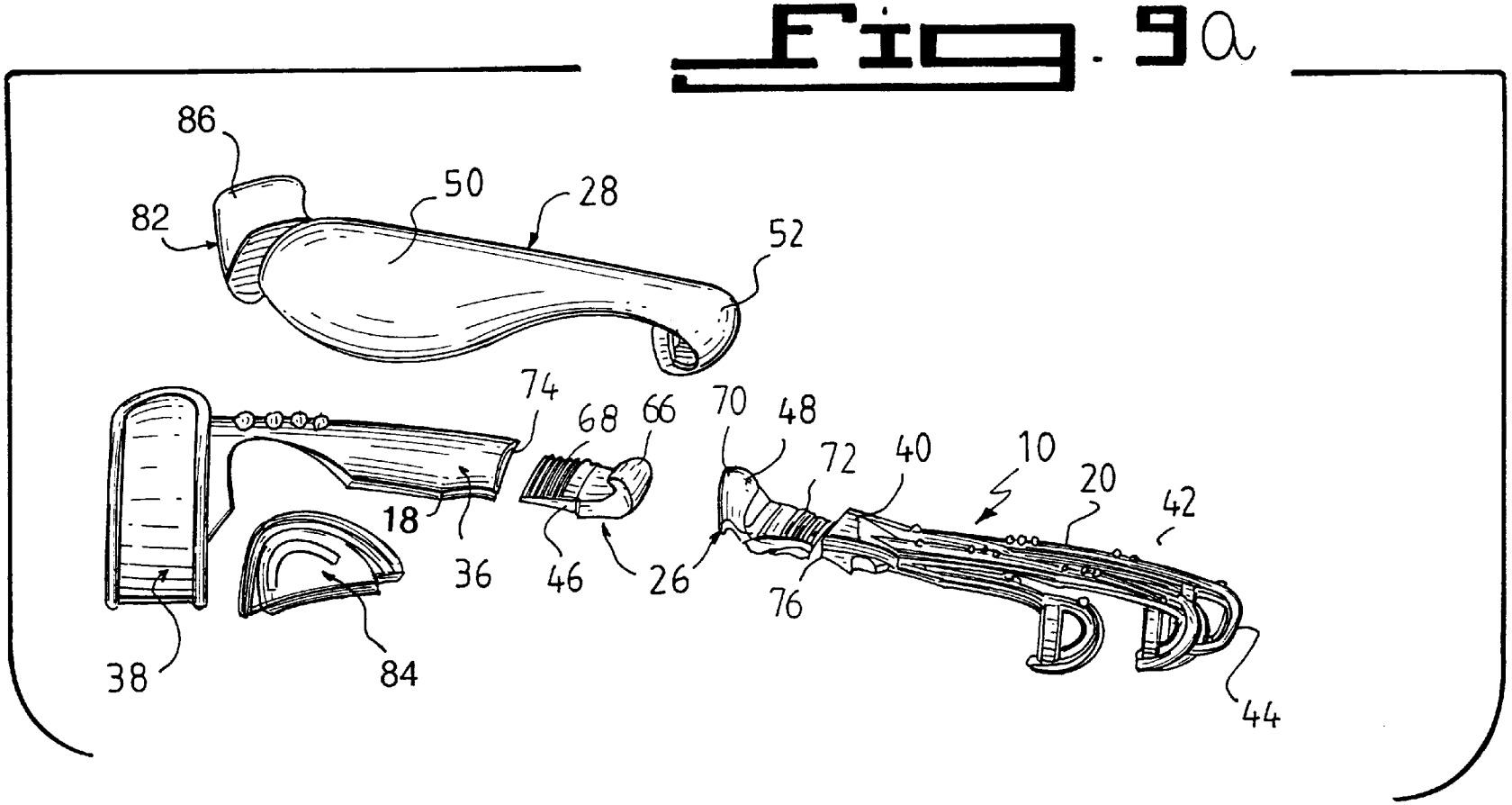
FIG. 9*a* is an exploded side view of the hand exerciser of the present invention shown in FIG. 9.

A side exploded view of the hand exerciser 10 is illustrated in FIGS. 9 and 9*a*. From these figures, the interconnection of each element of the hand exerciser 10 is shown. An alternate embodiment for the connector 26 is illustrated in these figures. The connector 26 includes the grip member 46 and the hook member 48. The grip member 46 includes a gripping portion 66 and a toothed connector portion 68. The hook member 48 includes a hook portion 70 and a toothed connector portion 72. The dorsal wrap 18 includes a recess 74 for receiving and releasably engaging the teeth on the connector portion 68 of the grip member 46. The toothed connector portion 68 forms an adjustable connection with the recess 74 whereby the distance the grip portion 46 extends from the recess 74 may be changed. The finger power band 20 also includes a recess 76 for receiving and releasably engaging the teeth on the connector portion 72 of the hook member 48. The toothed connector portion 72 forms an adjustable connection with the recess 76 whereby the distance the hook portion 48 extends from the recess 76 may be changed. The grip portion 66 and the hook portion 70 are releasably engaged to connect the dorsal wrap 18 to the finger power band 20.

An alternate embodiment for the connector assembly 82 is also shown in these Figures. The connector assembly 82 includes a socket member 84 and a plug member 86. In these figures, the plug member 86 is illustrated as being separated from the dorsal wrap 18. The plug member 86 is integrally connected to the thumb power band 28. In order to connect the thumb power band 28 to the dorsal wrap 18, the socket member 84 is positioned on a side of the dorsal wrap 18 opposite the thumb power band 28. The socket member 34 may include protrusions 80 which are caused to extend through the recess 78 and engage the plug member 86 for connecting the thumb power band 28 to the dorsal wrap 18.

The operation of the hand exerciser of the present invention will now be described with reference to the figures. In operation, the dorsal wrap 18 is connected to the finger power band 20 by engaging the grip member 46 and the hook member 48. When the grip member 46 and hook member 48 are engaged the pin 47 is caused to be received by and held within the recess 49. The user must carefully select the resistance desired from the finger power band based upon the user's hand strength and must also select the proper size finger power band based upon the length of the user's fingers. The thumb power band 28 is then connected to the dorsal wrap 18 by inserting the protrusion 54 into the recess 56. The hand exerciser is now ready for use.

The user will now place the hand exerciser on the desired hand by placing the fingers within the proper tip cups so that the finger covers extend along the surface of their respective finger and the thumb cover extends along the surface of the thumb. The wrist wrap 38 is now secured about the user's wrist. The user may now perform any hand exercise or simply go about their normal routine. As the fingers and hand are flexed, the hand exerciser will supply a resistance to the desired motion causing the muscles used to overcome the applied resistance and thereby exercise the muscles, tendons, joints and ligaments of the hand. The hand exerciser is unobtrusive and does not limit the full range of motion of the hand and thus the user is able to perform any desired activity.

When the user is finished using the hand exerciser, the wrist wrap 38 is simply released from its position about the wrist and the fingers of the user are removed from the tip cups. The hand exerciser may now be stored away until use at a future time is desired.

As the hand exerciser of the present invention is in the form of a glove, it conforms to the shape of the hand without the user needing to consciously hold it in position. This provides a great benefit for handicapped persons, persons affected by a stroke, multiple sclerosis patients with a major loss of hand strength, etc. who are unable to hold the hand exerciser in position. This also allows the user to now focus more on the exercise itself rather than the positioning or holding of the exerciser, therefore producing a highly effective exercise and much quicker results.

The hand exerciser is also beneficial to provide relief for certain hand problems such as muscular-skeletal problems degenerating, circulatory problems, nerve impingement, rhinos, etc., relief of stress and even provide relief for edema of the hands. Even healthy hands can benefit from use of the hand exerciser by increasing coordination, strength and endurance while helping to avoid hand fatigue.

The hand exerciser promotes increased blood circulation which therefore aids in decreasing the rehabilitation time for an injured hand by providing more blood and oxygen to the hand. This also prevents the formation of age marks and blemishes and allows the hand to function at its optimum level of performance.

The hand exerciser is also the only device available able to accommodate users of different strength levels with a single device, providing interchangeable parts of varying resistance levels. The interchangeable parts are identified by color power bands indicating the resistance level supplied by the part as well as a numbered scale system from 1–4 indicating a specific power band 20 resistance. The user can condition the exercise to be performed at a desired strength and resistance level by attaching the components of the desired level.

From the above description it can be seen that the hand exerciser of the present invention is able to overcome the shortcomings of the prior art devices by providing a hand exerciser which is able to be worn directly on a hand of a user or over a glove allowing the user to flex either the entire hand or any individual digit in a natural movement through a full range of motion providing a safe, highly effective exercise thereby increasing the strength, coordination and gripping ability of the hand and digits of the user as well as providing physical therapy for conditions such as arthritis, carpal tunnel syndrome, weak muscles and joints, post surgical weakness, etc. The hand exerciser will not inhibit the normal motion of the hands of the user and may be worn while performing any desired activity such as driving or playing sports without obstructing the use of the hand as the hand exerciser conforms to the shape of the users hand. The hand exerciser also provides for variable resistance levels for adapting to the strength level of different users and to the increasing strength level of a user exercising with the exerciser and allows for a full range of motion from full hand extension to full hand flexion. Furthermore, the hand exerciser is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An apparatus for exercising a hand of a user allowing a full range of motion of the hand during use, said apparatus comprising:

a) a dorsal wrap adapted to be releasably secured about a wrist of the user and extending over a back side of the hand, said dorsal wrap comprising a wrist band and an extension for covering substantially the entire back of the hand;

b) a finger power band releasably engaging said extension of the dorsal adapted to extend along the full length and only a portion of a surface of at least one finger including knuckle of the user, said finger power band being made of a material which provides a predetermined amount of resistance to movement of the finger sufficient for performing exercise of said finger;

c) a thumb power band releasably engaging said dorsal wrap and adapted to extend along the full length and only a portion of a surface of a thumb including knuckle of the user, said thumb power band being made of a material designed to provide a predetermined amount of resistance to movement of the thumb, said finger and thumb power bands all moving independently of each other allowing exercise of the entire hand, any individual finger, the thumb and any combination thereof; and d) a finger tip cup for receiving a tip of each finger having a power band.

2. The apparatus for exercising a hand as recited in claim 1, wherein said dorsal wrap includes;

a) a back cover for extending over the back of the hand of the user; and b) a wrist wrap integrally connected to said back cover for releasably securing said dorsal wrap to the wrist of the user.

3. The apparatus for exercising a hand as recited in claim 1, further comprising a connector for releasably connecting said dorsal wrap to said finger power band.

4. The apparatus for exercising a hand as recited in claim 3, wherein said connector includes a grip member connected to said dorsal wrap and a hook member connected to said finger power band, said hook member and said grip member being operable between a first separated position in which said dorsal wrap is disconnected from said finger power band and a second engaged position in which said dorsal wrap is connected to said finger power band.

5. The apparatus for exercising a hand as recited in claim 4, wherein said grip member includes a pin extending therefrom and said hook member includes a recess extending therethrough for receiving said pin when said grip member and said hook member are in said second engaged position.

6. The apparatus for exercising a hand as recited in claim 5, wherein said finger power band is one of a predetermined number of colors, each of said predetermined number of colors being indicative of a respective amount of resistance to movement provided by said finger power band.

7. The apparatus for exercising a hand as recited in claim 6, further comprising a plurality of finger power bands each providing a different resistance level, said resistance level being determined by a color of said finger power band and within a scaled system range of 1–4, a resistance level of 1 indicating said finger power band provides a minimum amount of resistance to movement and a resistance level of 4 indicating said finger power band provides a maximum amount of resistance to movement.

8. The apparatus for exercising a hand as recited in claim 1, wherein each finger tip cup includes a band extending therearound providing additional support for retaining each finger within its respective finger tip cup.

9. The apparatus for exercising a hand as recited in claim 4, wherein said finger power band further includes a knuckle covering connected between said at least one finger cover and said hook member for covering the knuckles on the hand of the user.

10. The apparatus for exercising a hand as recited in claim 4, wherein said grip member is adjustably and releasably connected to said dorsal wrap and said hook member is adjustably and releasably connected to said finger power band.

11. The method of exercising a hand of a user allowing a full range of motion of the hand during use, the steps of said method comprising:

a) releasably securing a dorsal wrap about a wrist of the user extending over a back side of the hand, said dorsal wrap comprising a wrist band and an extension for covering substantially the entire back of the hand;

b) releasably engaging a finger power band to said extension of said dorsal wrap extending along the full length and only a portion of a surface of each finger including knuckle of the user, said finger power band being made of a material which provides a predetermined amount of resistance to movement of each finger;

c) releasably engaging a thumb power band to said dorsal wrap extending along the full length and only a portion of a surface of a thumb including knuckle of the user, said thumb power band being made of a material designed to provide a predetermined amount of resistance to movement of the thumb, said finger and thumb power bands being capable of all moving independently of each other allowing exercise of the entire hand, any individual finger, the thumb and any combination thereof;

d) mounting a finger tip cup at the distal end of each power band for receiving a tip of each finger having a power band; and e) exercising said hand and fingers against the resistance provided by said power bands.

* * * * *